United States Patent [19]

Roberts et al.

[11] Patent Number: 4,673,250

[45] Date of Patent: Jun. 16, 1987

[54] $CO_2$ LASER WEAPON COUNTERMEASURE

[75] Inventors: Thomas G. Roberts, Huntsville; Thomas E. Honeycutt, Somerville, both of Ala.

[73] Assignee: The United States of America as represented by the Secretary of the Army, Washington, D.C.

[21] Appl. No.: 764,021

[22] Filed: Aug. 9, 1985

[51] Int. Cl.[4] ..... G01J 1/00; G02B 5/22; G02B 26/02

[52] U.S. Cl. ..... 350/320; 102/367; 250/338; 252/305; 342/13; 350/1.5

[58] Field of Search ..... 343/18 E; 102/367; 252/305; 342/1, 5, 12, 13; 250/338 R; 350/267, 1.5, 320

[56] References Cited

U.S. PATENT DOCUMENTS

| | | | |
|---|---|---|---|
| 2,524,590 | 10/1950 | Boe | 252/305 |
| 3,808,595 | 4/1974 | Coop et al. | 343/18 E |
| 3,992,628 | 11/1976 | Karney | 102/367 X |
| 4,406,815 | 9/1983 | Magnusson et al. | 343/18 E X |

*Primary Examiner*—Richard D. Lovering

*Attorney, Agent, or Firm*—John C. Garvin, Jr.; James T. Deaton

[57] ABSTRACT

A laser weapon countermeasure method in which a chemical countermeasure is deployed into the atmosphere along a predetermined length that is located between that which is desired to be protected and a high power laser weapon so as to cause the laser energy emanating from said laser weapon to bloom and be dissipated when the laser energy is directed into the atmosphere containing said chemical countermeasure.

5 Claims, 2 Drawing Figures

$CO_2$ LASER WEAPON COUNTERMEASURE

DEDICATORY CLAUSE

The invention described herein may be manufactured, used, and licensed by or for the Government for governmental purposes without the payment to us of any royalties thereon.

BACKGROUND OF THE INVENTION

In the past, many and varied lasers have been developed for performing various tasks in the military environment and lasers have now been developed of such strengths that they can be detrimental to personnel and equipment. Since these laser type devices can be detrimental to personnel and equipment, there is a need for providing for the protection of personnel and equipment from detrimental effects that can be produced when the laser weapon is used by the enemy to inflict injury.

Accordingly, it is an object of this invention to provide a method by which a high power laser can be defeated or prevented from performing its intended function by causing the laser beam to bloom and therefore be adversely effected.

Another object of this invention is to utilize substances that can be used in the atmosphere to enhance the effects of thermal bloominq and thereby adversely effect the operation of potential laser weapons in particular wavelengths of radiation.

Still another object of this invention is to provide means for deploying and dispensing substances into the atmosphere which adversely effect the intended performance of the laser.

Still another object of this invention is to provide a chemical countermeasure that utilizes substances with absorption coefficients that are so large that just a few parts per million of the chemical countermeasure in air will increase the absorption coefficient of air by an order of magnitude.

A still further object of this invention is to provide substances with absorption coefficient that can be used in such low concentration that even if the compounds are normally flammable they will not burn in the concentrations used to cause the thermal blooming laser energy.

Further objects of this invention will be obvious to those skilled in this art.

SUMMARY OF THE INVENTION

In accordance with this invention, a method or system is provided for protecting troops and equipment from laser radiation and this is accomplished by dispensing into the atmosphere a high density chemical substance which has a low diffusion coefficient and an extremely high absorption coefficient for laser radiation with this being placed between the source of the laser radiation and the personnel and materials desired to be protected so that the chemical substance causes the laser beam to bloom and be diffused such that it is reduced in power to such an extend as to be ineffective.

DETAILED DESCRIPTION OF THE INVENTION

Figures 1, 2:
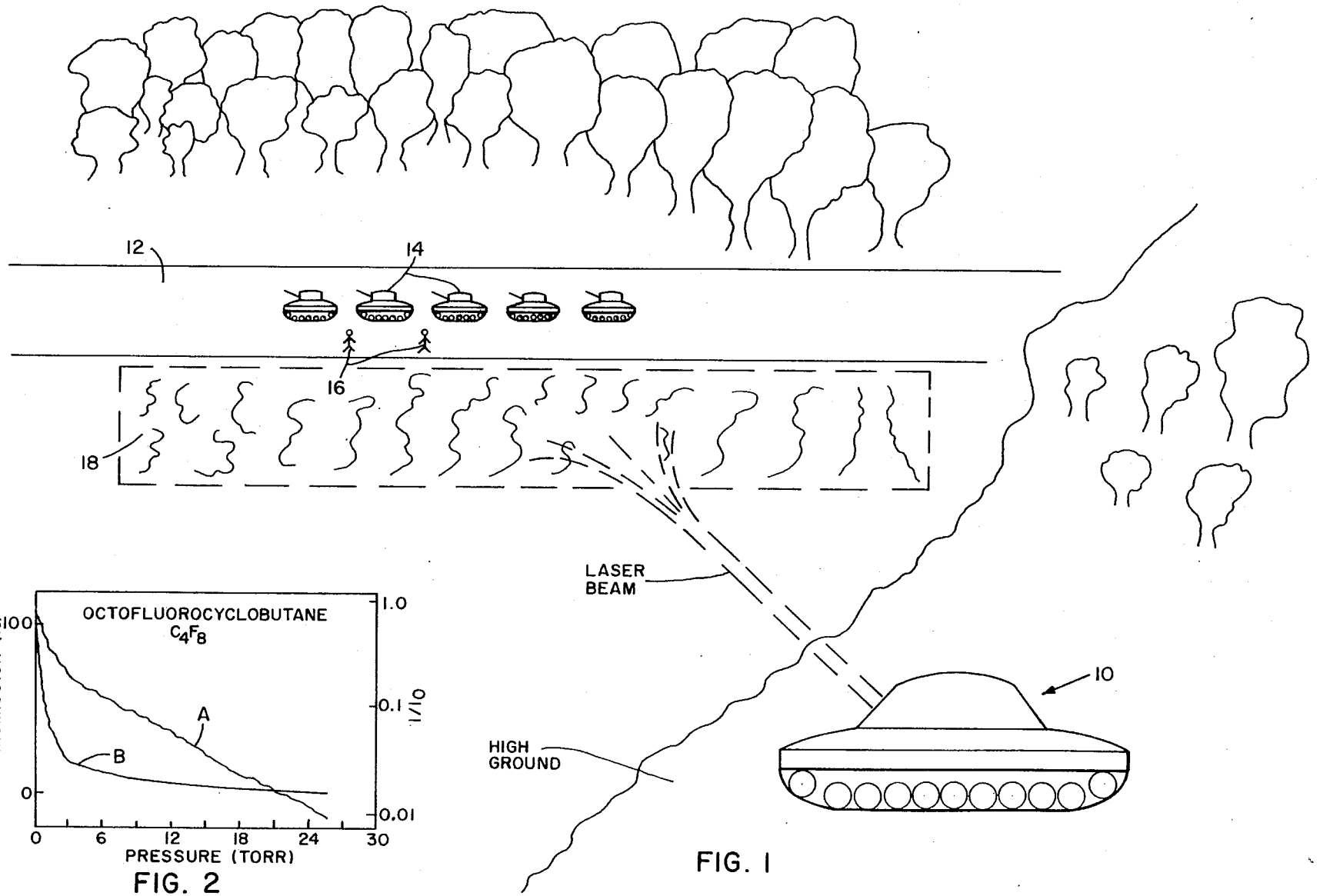
FIG. 1 is a schematic illustration of the laser countermeasure arrangement in accordance with this invention.
FIG. 2 is a plot of the measurements of the absorption coeffiecient of octafluorocyclobutane

To better understand applicants' invention and the principal of operation thereof it is noted that to increase the intensity of a laser beam on a distant target the output power of the laser is increased or, if practical, the laser is focused to a smaller spot at the target. In either case the intensity can only be increased to levels where the atmosphere becomes restructured by the laser beam itself. At this intensity level nonlinear phenomena such as air breakdown, laser supported absorption waves, or thermal blooming dominate propagation and determine the power density that can be achieved on a given target. In nearly all cases, and particularly in the case of thermal blooming, nonlinear effects are detrimental to laser beam propagation, contributing to both attenuation and beam spreading.

Simplistically speaking thermal blooming occurs because as the laser beam propagates through the atmosphere it heats the air. The heated air expands reducing the density and the index of refraction. Due to this change in the index of refraction, the air acts as a negative lens causing the laser radiation to diverge. An additional increase in the intensity causes an additional increase in the index of refraction and further divergence, thus reducing the power density on a target instead of increasing it.

The thermal effects including blooming, bending and distortion due to either wind or beam slewing can be calculated in all their complexity. See for example F. G. Gebhardt, "High Power Laser Propagation," Applied Optics, 15, No. 6, June 1976, p. 1479; L. C. Bradley and J. Hermann, "Phase Compensation for Thermal Blooming," Applied Opt., 13, 1974, p. 331; Breaux, et al., "Algebraic Model for CW Thermal Blooming Effects," Applied Optics, 18, Aug 1979, p. 2638; and references therein. An outline of the nature of these calculations is contained in Technical Report entitled "Laser Beam Propagation in the Atmosphere: The State of the Art" by Ronald I. Miller, March 1984.

The power density or the laser beam intensity at which thermal blooming becomes the limiting factor for propagation throuqh the atmosphere depends on the absorption coefficient. The limiting intensity is quite sensitive to the magnitude of the absorption coefficient since it appears as an exponent in the equation which determines the intensity at any point down range. For $CO_2$ laser radiation at 10.6 $\mu$m the magnitude of the absorption coefficient in the atmosphere is typically $2\times10^{-1}$ km$^{-1}$. For example, this is the mean absorption coefficient for Hanover, Germany. Magnitudes between $1.6\times10^{-1}$ km$^{-1}$ and $4.6\times10^{-1}$ km$^{-1}$ are generally used when studies of the effectiveness of potential weapons at 10.6 $\mu$M are made. Changes of a factor of 2 in the magnitude of the absorption coefficient can have a large detrimental effect on the usefulness of a weapon.

If the atmosphere is seeded with a high density substance which has a low diffusion coefficient and an extremely high absorption coefficient for the laser radiation, then the atmosphere is much more efficiently heated, and thermal blooming limits the achievable power density delivered to a distance target to a very low value. Thus negating the effectiveness of the laser weapon.

In this countermeasure arrangement, 12 substances whose absorption coefficients for $CO_2$ laser radiation near 10.6 μm are in the range between $6\times10^4$ km$^{-1}$ and $3\times10^5$ Km$^{-1}$, which is approximately one million times larger than that of atmospheric air. Attenuation measurements in the laboratory have shown that many compounds are good absorbers of $CO_2$ laser radiation and some of these compounds are nonflammable, nontoxic, and nonreactive, and therefore are safe in the instant application and in other applications requiring the absorbing gas to be mixed with other gases. The 12 gases which have been found to absorb the $CO_2$ laser radiation best are listed in Table I below. The physical and chemical properties of interest in various applications are also listed in Table I. The absorption coefficients for wavelengths near 10.6 μm listed in column 3 were measured using an inhouse cw $CO_2$ laser which produced about 40 W of unpolarized radiation in four or five P branch transitions. The output power of the laser was fairly constant, but the power in any one transition varied considerably. Therefore, the measured absorption coefficients are averaged over these wavelengths. The measurements were made by passing the laser beam throuqh an absorption cell which was 56.7 cm long and varving the pressure within the cell between 0 and 30 Torr. Both the intensity vs pressure and the log intensitv vs pressure were plotted on an X-Y recorder. The absorption coefficients were then obtained from the slope of the log intensity vs pressure plots. A least squares fit of the intensity vs pressure data gave values which agreed with these to within 10% where checks were made.

cated two values for the absorption coefficient and seems to change values at some pressure less than 3 Torr as indicated in FIG. 2, where curve A is a plot of log I vs P, and curve B is a plot of I vs P. These curves are reproducible. However, no explanation consistent with all of the experimental data is offered for this effect.

The absorption coefficients of these compounds are so large that just a few parts per million increases the absorption coefficient of air by an order of magnitude. At these low concentrations even the compounds which are normally flammable will not burn and may be used in the system and method of this invention.

Referring now to the drawings, in FIG. 1 a layout of the system utilizing the method of chemical countermeasure is illustrated and includes a high power laser weapon 10 that is located and deployed for directing its energy for defeating personnel and equipment such as illustrated on road 12 as tanks 14 and personnel 16. To render the high power laser weapon 10 ineffective, a chemical substance such as one of the 12 listed above or another equivalent chemical material is placed in the atmosphere in the line of sight between high powered laser weapon 10 and tank 14 and personnel 16. As illustrated, the chemical countermeasure is deployed in the dashed-in-area 18. The chemical countermeasure is laid down along the area 18 so as to be in the line of sight between the high powered laser weapon 10 and the personnel and/or equipment that is desired to be protected. The chemical countermeasure along area 18 is deployed by a low flying aircraft similar to a crop duster which dispenses the chemical countermeasure in

TABLE 1

PROPERTIES OF COMPOUNDS FOR USE AS OPTICAL ATTENUATORS OF 10.6 μm

| Compound | Formula | α (Torr$^{-1}$ cm$^{-1}$) | Flammable | Toxicity | Density liquid (g/cm$^3$) | Boiling point (°C.) | Vapor pressure 21° C. (Torr) | General properties |
|---|---|---|---|---|---|---|---|---|
| 1,1-difluoroethylene | $C_2H_2F_2$ | $3.5\times10^{-3}$ | yes | none | 0.617 | −83 | $2.7\times10^4$ | colorless, faint odor has general properties of olefins |
| dichlorodifluoromethane | $CCl_2F_2$ | $8.1\times10^{-4}$ | no | very little | 1.292 | −30 | $3.6\times10^3$ | colorless, faint odor thermally stable |
| perfluoro-2-butene | $C_4F_8$ | $2.4\times10^{-3}$ | no | moderate | 1.530 | 1.2 | $7.7\times10^2$ | colorless, little data available |
| octafluorocyclobutane | $C_4F_8$ | $4.1\times10^{-3}$ $2.5\times10^{-3}$ | no | none | 1.513 | −6 | $1.3\times10^3$ | colorless, odorless, tasteless, extremely stable, unreactive |
| choropentafluoroethane | $C_2ClF_5$ | $8.1\times10^{-4}$ | no | low | 1.26 | −39 | $5.2\times10^3$ | colorless, mild odor, stable, nonreactive with metals |
| 1,2-dichlorotetrafluoroethane | $C_2Cl_2F_4$ | $2.7\times10^{-3}$ | no | very low | 1.440 | 3.6 | $6.7\times10^2$ | colorless, odorless, thermally stable |
| 1,1-difluoro-1-chloroethane | $C_2H_3F_2Cl$ | $1.5\times10^{-3}$ | yes | low | 1.118 | −9.2 | $1.5\times10^3$ | colorless, fairly reactive chemically |
| 1,1-difluoroethane | $C_2H_4F_2$ | $3.5\times10^{-3}$ | yes | very low | 1.012 | −25 | $3.2\times10^3$ | colorless, very stable toward hydrolysis |
| 3-methyl-1-butene | $C_5H_{10}$ | $8.0\times10^{-4}$ | yes | asphyxiant | 0.627 | 20 | $1.0\times10^2$ | colorless, undergoes typical olefin reactions |
| ethylene | $C_2H_4$ | $1.5\times10^{-3}$ | highly | asphyxiant | 0.567 | −104 | $6.2\times10^4$ | colorless, sweet odor olefin reactions |
| propylene | $C_3H_6$ | $1.75\times10^{-3}$ | yes | asphyxiant | 0.514 | −48 | $7.0\times10^4$ | colorless, olefin reactions |
| dimethyl ether | $C_2H_6O$ | $1.89\times10^{-3}$ | yes | anesthesia narcotic | 0.724 | −25 | $3.1\times10^3$ | colorless, ethereal odor |

All of the compounds listed in Table I behaved similarly in the absorption cell except for sulfur hexafluoride, which is not listed, and octafluorocyclobutane. The absorption coefficient for sulfur hexafluoride varied with the output power of the laser, presumably due to saturation effects, and octafluorocyclobutane indithe area designated 18 and in the space above area 18 to form something similar to a smoke screen that is in the line of sight between laser weapon 10 and the personnel and equipment desired to be protected. Also, the chemical countermeasure can be dispensed by being predeployed in disposable containers and then released on command when needed or the chemical countermeasure substance can be dispensed from a shell similar to the manner of deploying smoke screens. The chemical countermeasure is dispensed in the atmosphere so as to form basically a cloud from ground level up to a predetermined height sufficient to block the energy from laser weapon 10 to the personnel and equipment desired to be protected. If the chemical countermeasure is dispensed from disposable containers, the disposable containers are something like those used to contain insecticide in so-called room fogqers except that the release mechanism is remotely controlled by telemetry. The signal to remotely control release of the chemical countermeasure is coded so as to insure that the chemical countermeasure is only released when desired. This method of deployment is best used in a defense mode to protect fixed values. It is also noted that devices of this type can be distributed by drops or missiles and then at a later time the chemical countermeasure can be released on demand. In any event, this countermeasure method of deploying chemical into the atmosphere to produce a chemical laden atmosphere causes a high powered laser of the 10.6 μm to completely bloom or to bloom and disperse the energy sufficiently to render it ineffective against personnel and equipment. Even though chemical countermeasures in the 12 proposed chemicals is mainly directed at protecting against 10.6 micrometer laser weapons, other chemical countermeasures can be used against other wavelengths to produce substantially the same effects. It is also pointed out for example, $CH_3CH_2CH_2DHm$ n-butane, $CH_3OCH_3$ dimethyl ether, $C_2H_3Cl$ ethyl chloride, $CH_3SH$ methyl mercaptan, trimethylhydrazine

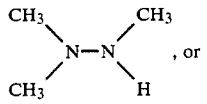

, or $CH_3CH(OC\ H_3)_2$ 1,1-dimethoxyethane can be used as a chemical countermeasure against chemical laser weapons operating at near 3.8 μm wavelengths. It is further pointed out that dimethyl ether can be used as a countermeasure against 10.6 μm and 3.8 μm weapons simultaneously.

EXAMPLE

To effectively protect the flank of a 1 km tank or truck column during the time required for safe passage down road 12 and from high powered laser weapon 10 one should use between 2 and 10 pounds dispensed along 1 km column as illustrated at 18 and depending upon the compound used as to whether 2 or 10 pounds are used. Two pounds of $C_2H_2F_2$ is effective if this chemical is used and 10 pounds is effective if $C_5H_{10}$ is used. Amounts between 2 and 10 pounds are required for the other compounds listed in Table I.

The effectiveness of the chemical countermeasure as a laser screen at 18 decreases slowly compared to the time required for a column such as of tanks 14 to negotiate 1 km. Thus, protection at a slowly decreasing level is provided for long times. If additional time is desired or needed, more chemical countermeasure can be provided in the atmosphere to be effective against the laser radiation from high power laser weapon 10.

In operation, when it is desired to protect armament such as 14 and/or personnel 16, the chemical laser countermeasure selected from chemicals such as the 12 listed in Table I is deployed in area 18 to form a cloud or atmosphere that is seeded substantially from the ground up a predetermined distance with the chemical countermeasure so that when high power laser weapon 10 is utilized to defeat tanks 14 or personnel 16, the laser energy emanating from laser weapon 10 will be caused to bloom and the energy thereof dissipated so as not to be effective against personnel 16 and/or tanks or other equipment such as 14. In this manner, an effective means is provided for protection of personnel 16 as well as equipment 14.

We claim:

1. A laser weapon countermeasure method comprising dispensing a chemical countermeasure into air of the atmosphere between that which is desired to be protected and a high power laser weapon so that said chemical countermeasure is provided along a predetermined length and of a predetermined height so as to be in the line of sight between the high power laser weapon and that which is desired to be protected, said chemical countermeasure in said atmosphere being sufficient to cause high powered laser energy radiation of 10.6 μm from said laser weapon to bloom and be dissipated and allow that desired to be protected to pass by and out of range of said high powered laser weapon, said chemical countermeasure consisting of a chemical selected from the group consistings of 1,1-difluoroethylene, dichlorodifluoromethane, perfluoro-2-butene, octafluorocyclobutane, chloropentafluoroethane, 1,2-dichlorotetrafluoroethane, 1,1-difluoro-1-chlorethane, 1,1-difluoroethane, 3-methyl-1-butene, ethylene, propylene, and dimethyl ether, and said chemical countermeasure being dispensed in an amount of about 2 to about 10 pounds over a length of about 1 km.

2. A laser wepon countermeasure method as set forth in claim 1, wherein said chemical countermeasure employed is dispensed into the atmosphere from a multiplicity of positions.

3. A laser wepon countermeasure method as set forth in claim 1, wherein said chemical countermeasure is dispensed into the atmosphere from a low flying craft.

4. A laser wepon countermeasure method as set forth in claim 1, wherein said chemical countermeasure is dispensed from ground level.

5. A laser weapon countermeasure method as set forth in claim 4, wherein said selected chemical countermeasure is dimethyl ether.

* * * * *